US011329401B2

(12) United States Patent
Johnson et al.

(10) Patent No.: US 11,329,401 B2
(45) Date of Patent: May 10, 2022

(54) ELECTRICAL CONNECTION BAILS AND STIRRUP SYSTEMS AND METHODS INCLUDING SAME

(71) Applicant: Tyco Electronics Canada ULC, Markham (CA)

(72) Inventors: Barry James Johnson, Vaughan (CA); Jonathan Guppy, Ajax (CA)

(73) Assignee: TYCO ELECTRONICS CANADA ULC, Markham (CA)

( * ) Notice: Subject to any disclaimer, the term of this patent is extended or adjusted under 35 U.S.C. 154(b) by 116 days.

(21) Appl. No.: 16/787,685

(22) Filed: Feb. 11, 2020

(65) Prior Publication Data

US 2020/0266554 A1 Aug. 20, 2020

Related U.S. Application Data

(60) Provisional application No. 62/807,890, filed on Feb. 20, 2019.

(51) Int. Cl.

| | |
|---|---|
| ***H01R 4/2407*** | (2018.01) |
| ***H01R 13/66*** | (2006.01) |
| ***H01R 43/26*** | (2006.01) |
| ***H01R 4/30*** | (2006.01) |

(52) U.S. Cl.

CPC ..... *H01R 4/2407* (2018.01); *H01R 4/305* (2013.01); *H01R 13/665* (2013.01); *H01R 43/26* (2013.01)

(58) Field of Classification Search

CPC .... H01R 4/2407; H01R 4/305; H01R 13/665; H01R 43/26; H01R 4/20; H01R 4/2408; H01R 4/44; H01R 9/03

See application file for complete search history.

(56) References Cited

U.S. PATENT DOCUMENTS

| | | | | |
|---|---|---|---|---|
| 2,895,002 A * | 7/1959 | Dupre | H01R 4/62 174/71 R |
| 3,275,974 A * | 9/1966 | Mixon, Jr. | H01R 4/50 439/783 |
| 3,290,746 A | 12/1966 | Broske | |
| 3,345,454 A | 10/1967 | Mixon, Jr. | |
| 3,515,794 A | 6/1970 | Beinhaur et al. | |
| 3,668,613 A * | 6/1972 | Klosin | H01R 4/2495 439/410 |
| 3,681,512 A | 8/1972 | Werner et al. | |

(Continued)

FOREIGN PATENT DOCUMENTS

| | | |
|---|---|---|
| CA | 2334187 A1 | 8/2002 |
| CN | 2634667 Y | 8/2004 |

(Continued)

OTHER PUBLICATIONS

"Automatic connectors Reliable for wires, strands and conductors" Dribo, spol. s r.o. (4 pages) (Oct. 2003).

(Continued)

*Primary Examiner* — Abdullah A Riyami
*Assistant Examiner* — Nader J Alhawamdeh

(57) ABSTRACT

A bail for forming a mechanical and electrical connection includes an inboard section and an outboard section. The inboard section includes an elongate, electrically conductive multi-strand conductor. The outboard section includes an elongate, electrically conductive solid rod conductor electrically connected to the multi-strand conductor.

29 Claims, 13 Drawing Sheets

(56) References Cited

U.S. PATENT DOCUMENTS

| | | | | |
|---|---|---|---|---|
| 3,742,582 | A | 7/1973 | Broske | |
| 3,761,602 | A | 9/1973 | De Sio et al. | |
| 3,826,860 | A | 7/1974 | De Sio et al. | |
| 4,027,939 | A | 6/1977 | White | |
| 4,114,977 | A | 9/1978 | Polidori | |
| 4,252,992 | A | 2/1981 | Cherry et al. | |
| 4,279,461 | A | 7/1981 | Bussen et al. | |
| 4,415,222 | A | 11/1983 | Polidori | |
| 4,600,264 | A | 7/1986 | Counsel | |
| 4,722,189 | A | 2/1988 | Center | |
| 4,752,252 | A | 6/1988 | Cherry et al. | |
| 4,857,020 | A * | 8/1989 | Crosby | H01R 4/5091 439/783 |
| 4,863,403 | A | 9/1989 | Shannon | |
| RE33,098 | E | 10/1989 | Center | |
| 5,090,923 | A | 2/1992 | Kenyon et al. | |
| 5,092,797 | A | 3/1992 | Cole et al. | |
| 5,244,422 | A | 9/1993 | Laricchia | |
| 5,340,335 | A | 8/1994 | Haun | |
| 5,423,699 | A | 6/1995 | Johnson | |
| 5,538,447 | A | 7/1996 | Chadbourne et al. | |
| 5,600,096 | A | 2/1997 | Cherry et al. | |
| 5,683,273 | A | 11/1997 | Garver et al. | |
| 5,692,930 | A | 12/1997 | Garver et al. | |
| 5,704,816 | A * | 1/1998 | Polidori | H01R 4/44 403/391 |
| 5,774,987 | A | 7/1998 | Chadbourne et al. | |
| 5,794,334 | A | 8/1998 | Chadbourne et al. | |
| 5,862,589 | A | 1/1999 | Chadbourne et al. | |
| 5,916,001 | A | 6/1999 | Chadbourne | |
| 6,093,064 | A | 7/2000 | Callen et al. | |
| 6,106,323 | A | 8/2000 | Elisei et al. | |
| 6,261,117 | B1 | 7/2001 | LaCroix | |
| 6,309,261 | B1 | 10/2001 | Chadbourne | |
| 6,817,909 | B2 | 11/2004 | Dobrinski et al. | |
| 6,851,262 | B1 | 2/2005 | Gregory et al. | |
| 6,895,663 | B2 | 5/2005 | Itrich | |
| 6,979,236 | B1 | 12/2005 | Stanton | |
| 6,996,987 | B2 | 2/2006 | Gregory et al. | |
| 7,182,653 | B1 | 2/2007 | Hoxha | |
| 7,309,263 | B2 | 12/2007 | Copper et al. | |
| 7,387,546 | B2 | 6/2008 | Copper et al. | |
| 7,426,782 | B2 | 9/2008 | Johnson et al. | |
| 7,494,385 | B2 | 2/2009 | Copper et al. | |
| 7,677,933 | B2 * | 3/2010 | Copper | H01R 4/38 439/781 |
| 7,686,661 | B2 | 3/2010 | Shrum et al. | |
| 7,766,702 | B2 | 8/2010 | De France et al. | |
| 7,819,706 | B2 | 10/2010 | Copper et al. | |
| 7,845,990 | B2 | 12/2010 | Shrum et al. | |
| 7,862,390 | B2 | 1/2011 | Copper | |
| 7,997,943 | B2 | 8/2011 | Gregory et al. | |
| 8,176,625 | B2 | 5/2012 | Copper et al. | |
| 8,444,431 | B1 * | 5/2013 | La Salvia | H01R 4/2408 439/404 |
| 8,469,721 | B2 | 6/2013 | Mitchell et al. | |
| 8,550,842 | B1 | 10/2013 | Gutierrez et al. | |
| 8,608,517 | B2 | 12/2013 | La Salvia et al. | |
| 8,932,087 | B2 * | 1/2015 | Neal | H01R 11/14 439/776 |
| 9,059,522 | B2 * | 6/2015 | Spalding | H01R 43/26 |
| 9,287,673 | B2 * | 3/2016 | Galla | H01R 9/031 |
| 10,680,353 | B2 * | 6/2020 | Murugiah | H01R 4/5091 |
| 2003/0148671 | A1 | 8/2003 | Mello et al. | |
| 2004/0029455 | A1 | 2/2004 | Johnson et al. | |
| 2004/0203294 | A1 | 10/2004 | Mello et al. | |
| 2006/0148333 | A1 | 7/2006 | Peterson | |
| 2006/0148334 | A1 | 7/2006 | Conn et al. | |
| 2008/0026644 | A1 | 1/2008 | De France et al. | |
| 2008/0050987 | A1 * | 2/2008 | Copper | H01R 4/5091 439/781 |
| 2010/0003864 | A1 | 1/2010 | Fuzetti et al. | |
| 2010/0015862 | A1 * | 1/2010 | Gregrory | H01R 4/38 439/783 |
| 2010/0151735 | A1 | 6/2010 | Crutcher et al. | |
| 2010/0314232 | A1 | 12/2010 | Gregory et al. | |
| 2015/0162670 | A1 * | 6/2015 | Galla | H01R 43/01 29/872 |
| 2018/0342818 | A1 * | 11/2018 | Johnson | H01R 4/5083 |
| 2020/0076094 | A1 * | 3/2020 | Murugiah | H01R 4/5091 |
| 2020/0266554 | A1 * | 8/2020 | Johnson | H01R 4/2408 |

FOREIGN PATENT DOCUMENTS

| | | | |
|---|---|---|---|
| EP | 2871720 | A1 | 5/2015 |
| GB | 813121 | A | 5/1959 |
| WO | 00/01035 | A2 | 1/2000 |
| WO | 2008/013891 | A2 | 1/2008 |
| WO | 2020170188 | A1 | 8/2020 |

OTHER PUBLICATIONS

Ampact Taps, Stirrups, and Application Tooling, Customer Manual 409-2106 Rev M (39 pages) (Feb. 5, 1999).

Grupo Intelli General Catalog www.grupointelli.com IntMKT Set/2009 (52 pages) (Jan. 2009).

Shear-Lok Grounding Connector data sheet, TE Connectivity (2 pages) (2014).

Tyco Electronics Energy Division Ready Reference Guide, retrieved from http://energy.tycoelectronics.com (143 pages) (Published at least as early as Sep. 2011).

U.D.C.—Universal Distribution Connector Reinforced, Tyco Electronics Catalog 125003 (8 pages) (Mar. 1999).

Wrench-Lok data sheet, TE Connectivity (2 pages) (2014).

"Tap connectors with closed bail" Sicame, from URL: http://www.thibidiphanan.com/uploads/userfiles/file/sicame2009-2010.pdf (p. 2-21; 1 page) (Nov. 2008).

International Preliminary Report on Patentability corresponding to International Patent Application No. PCT/IB2020/051426 (10 pages) (dated Aug. 10, 2021).

International Search Report and the Written Opinion of the International Searching Authority corresponding to International Patent Application No. PCT/IB2020/051426 (13 pages) (dated May 13, 2020).

* cited by examiner

ELECTRICAL CONNECTION BAILS AND STIRRUP SYSTEMS AND METHODS INCLUDING SAME

RELATED APPLICATION(S)

The present application claims the benefit of and priority from U.S. Provisional Patent Application No. 62/807,890, filed Feb. 20, 2019, the disclosure of which is incorporated herein by reference in its entirety.

FIELD OF THE INVENTION

The present invention relates to connectors and methods for forming electrical connections and, more particularly, to electrical connection bails and electrical connection stirrups.

BACKGROUND OF THE INVENTION

Electrical conductors often must be terminated or joined in various environments, such as underground or overhead. Such conductors may be, for example, high voltage electrical distribution or transmission lines. In order to form such connections, a connector may be employed. For example, in electrical power systems, it is occasionally necessary to tap into an electrical power line. One known system for tapping into an electrical power line is to use a tap connector for electrically connecting a main line electrical cable to an end of a tap line electrical conductor.

Insulation piercing (IP) connectors are commonly used to form mechanical and electrical connections between insulated cables. Typically, an IP connector includes metal piercing blades with sets of teeth on either end thereof. The piercing blades are mounted in housing members (e.g., along with environmental sealing components). The housing members are clamped about the insulated main and tap cables so that one set of teeth of a piercing blade engages the main cable and the other set of teeth of the piercing blade engages the tap cable. The teeth penetrate the insulation layers of the cables and make contact with the underlying conductors, thereby providing electrical continuity between the conductors through the piercing blade.

SUMMARY OF THE INVENTION

According to some embodiments of the invention, a bail for forming a mechanical and electrical connection includes an inboard section and an outboard section. The inboard section includes an elongate, electrically conductive multi-strand conductor. The outboard section includes an elongate, electrically conductive solid rod conductor electrically connected to the multi-strand conductor.

According to some embodiments of the invention, a stirrup system includes a bail and an insulation piercing connector. The bail includes an inboard section and an outboard section. The inboard section includes an elongate, electrically conductive multi-strand conductor. The outboard section includes an elongate, electrically conductive solid rod conductor electrically connected to the multi-strand conductor. The insulation piercing connector includes at least one electrically conductive piercing member, and a clamping mechanism. The clamping mechanism is configured and operable to force the at least one piercing member into electrical engagement with the multi-strand conductor.

According to method embodiments of the invention, a method for forming an electrical connection assembly with a cable, the cable including a cable conductor covered by a cable insulation layer, includes providing a bail. The bail includes: an inboard section including an elongate, electrically conductive multi-strand conductor; and an outboard section including an elongate, electrically conductive solid rod conductor electrically connected to the multi-strand conductor. The method further includes providing an insulation piercing connector including at least one electrically conductive piercing member, and a clamping mechanism. The method further includes selectively operating the clamping mechanism to force the at least one piercing member through the cable insulation layer and into electrical engagement with the multi-strand conductor and the cable conductor such that the multi-strand conductor and the cable conductor are electrically connected to one another through the at least one piercing member, and the solid rod conductor is thereby electrically connected to the cable conductor.

According to some embodiments of the invention, an electrical connection assembly includes a cable, a bail, and an insulation piercing connector. The cable includes a cable conductor covered by a cable insulation layer. The bail includes an inboard section and an outboard section. The inboard section includes an elongate, electrically conductive multi-strand conductor. The outboard section includes an elongate, electrically conductive solid rod conductor electrically connected to the multi-strand conductor. The insulation piercing connector includes at least one piercing member penetrating through the cable insulation layer and into electrical engagement with the multi-strand conductor and the cable conductor such that the multi-strand conductor and the cable conductor are electrically connected to one another through the at least one piercing member, and the solid rod conductor is thereby electrically connected to the cable conductor.

DESCRIPTION

Figure 1:
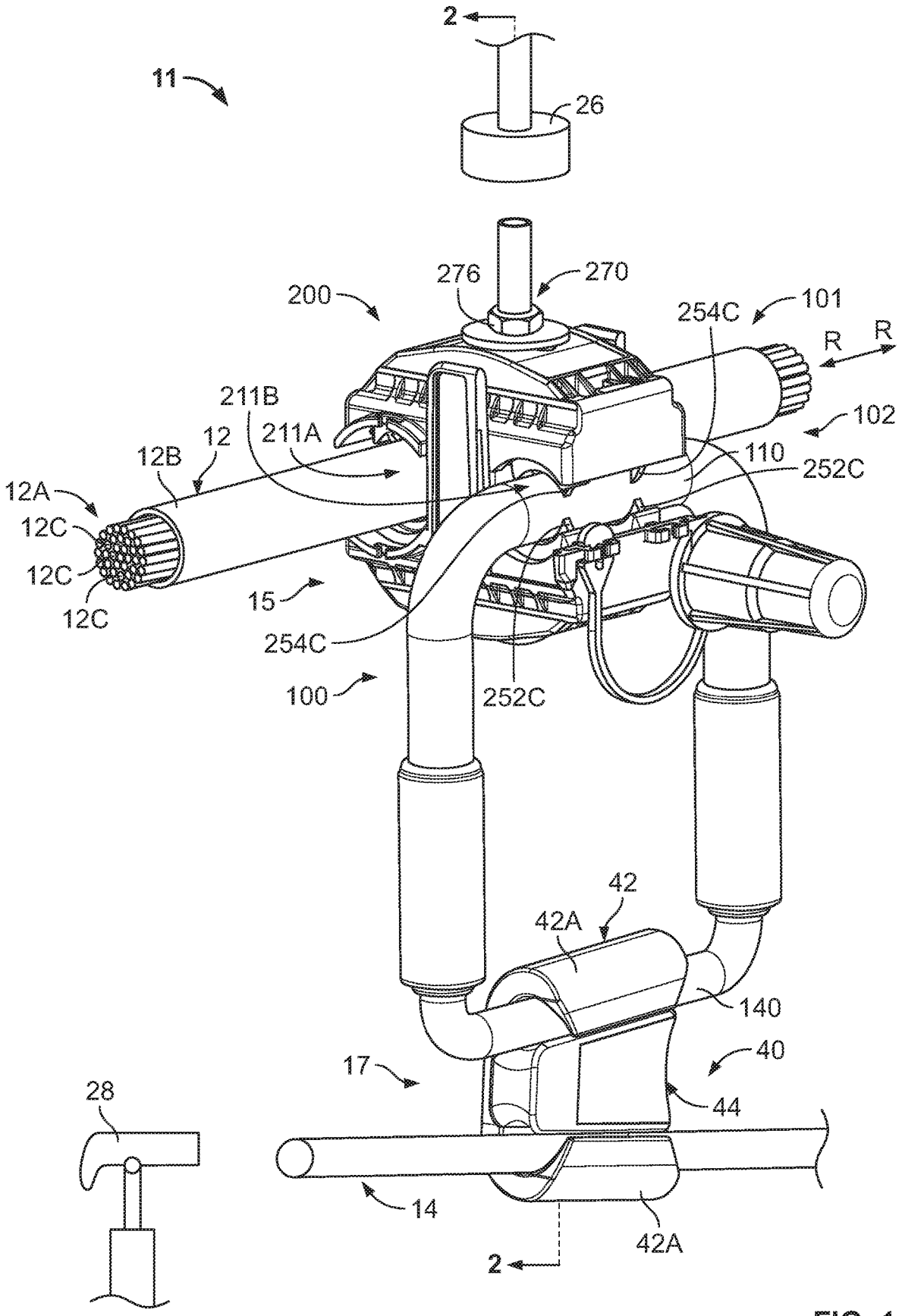
FIG. 1 is a perspective view of an electrical connection assembly including a stirrup system and a stirrup according to some embodiments.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-9, a bail 100, a stirrup system 101, and a stirrup 102 according to embodiments of the present invention are shown therein. The stirrup system 101 includes the bail 100 and a stirrup connector 200. The stirrup connector 200 is an insulation piercing connector (which may be referred to herein as an IPC, IP connector, or IPC connector). The stirrup system 101 can be assembled to form the stirrup 102.

The stirrup 102 may be installed on a first or main elongate conductor cable 12 to form a main connection assembly 15, wherein the IPC connector 200 mechanically and electrically couples the bail 100 to the cable 12. A second or tap elongate conductor cable 14 may additionally be installed on the stirrup 102 to form a tap connection assembly 17. The tap connection assembly 17 may include a tap connector 40 mechanically and electrically coupling the cable 14 to the bail 100. The cables 12, 14, the stirrup 102, the tap connector 40, the main connection assembly 15, and the tap connection assembly 17 collectively form an electrical connection assembly 11 wherein the stirrup 102 and the tap connector 40 mechanically and electrically couple the cable 14 to the cable 12.

In some embodiments, the cables 12, 14 are electrical power lines. In some embodiments, the cables 12, 14 are aerial (overhead) electrical power lines of a utility power distribution system, for example. The cable 12 may be an energized electrical transmission line of high voltage to a transformer Generally, and as described in more detail below, a driver 26 (FIG. 1) may be used to secure the connector 200 on the cable 12 and the bail 100. A hotstick 28 may be used to secure the cable 14 and the tap connector 40 to the bail 100.

Figure 4:
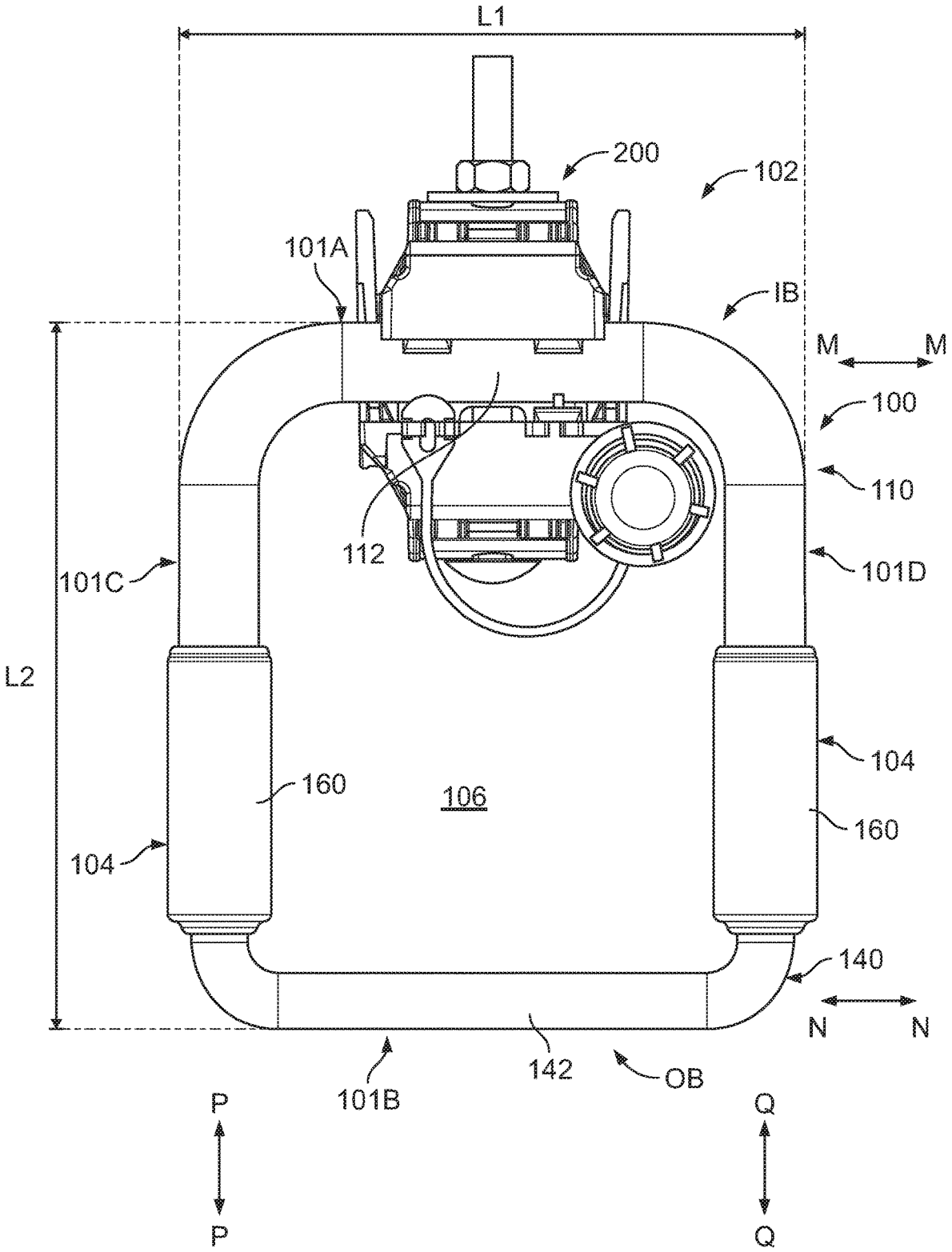
FIG. 4 is a front view of the stirrup of FIG. 1.
Figure 5:
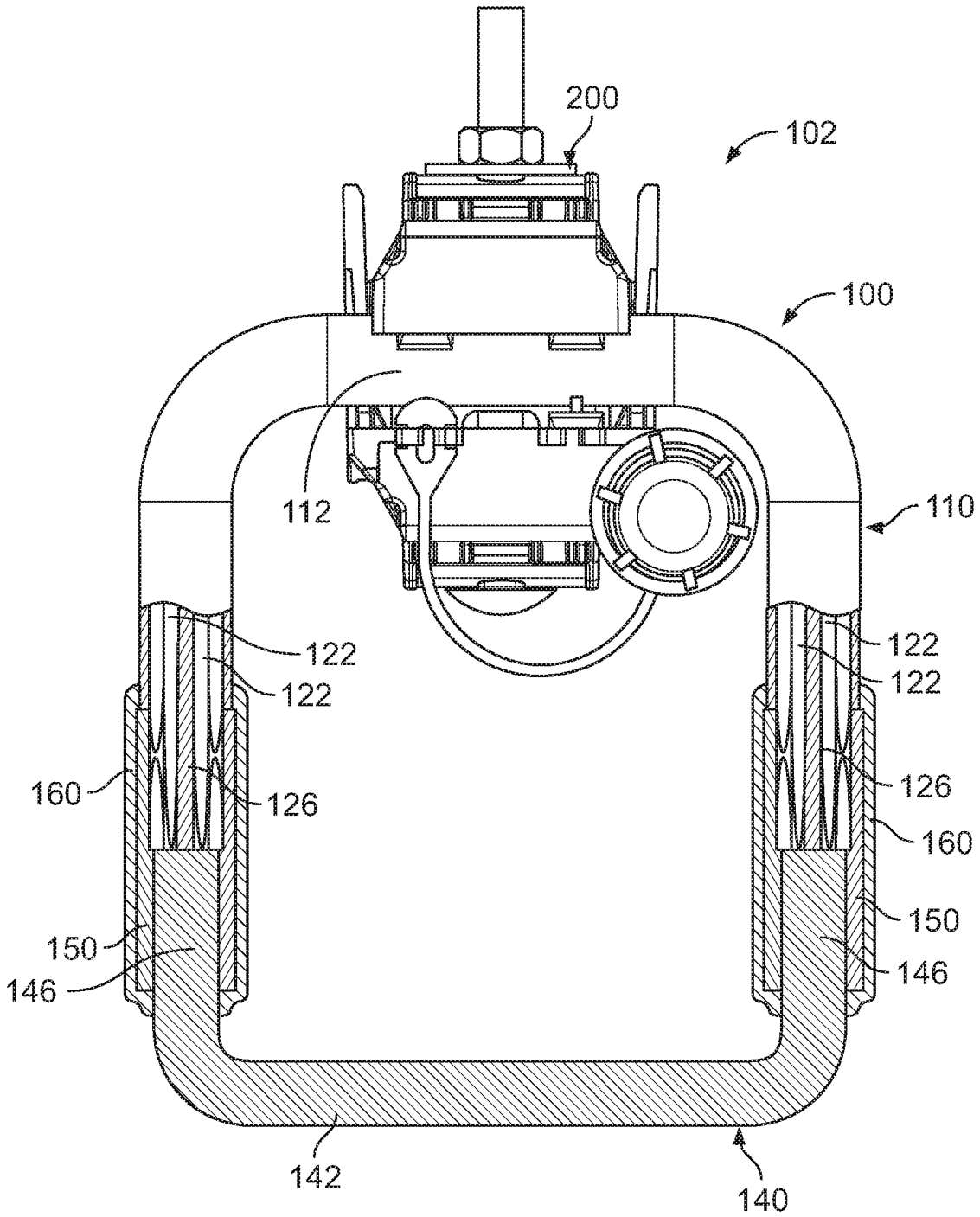
FIG. 5 is a fragmentary, front view of the stirrup of FIG. 1.
Figure 6:
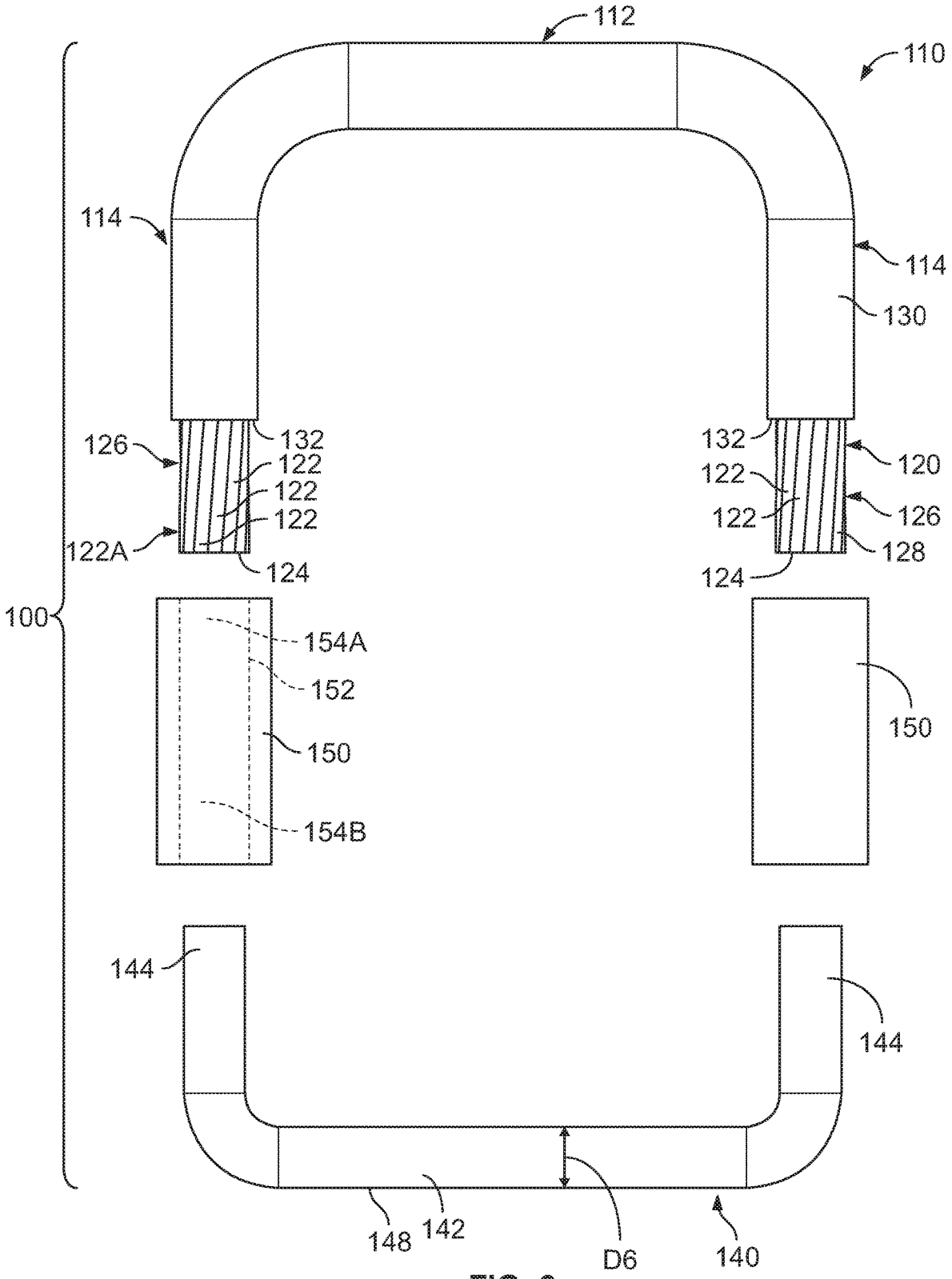
FIG. 6 is an exploded, front view of a bail according to some embodiments and forming a part of the stirrup of FIG. 1, wherein joint connectors forming a part of the bail are shown prior to being crimped.

With reference to FIGS. 4-6, the bail 100 has an inboard side IB and an outboard side OB. The bail 100 includes a first, inner or inboard section or member 110 and a second, outer or outboard section or member 140 joined at opposed joints 104 by a pair of joint fittings or connectors 150. The bail 100 includes an inner or inboard leg 101A, an outer or outboard leg 101B opposing the inboard leg 101A, and a pair of opposed side legs 101C, 101D connecting the ends of the legs 101A and 101B. The legs 101A-D define an opening 106. In some embodiments and as shown, the bail 100 forms a closed or endless loop. In some embodiments and as shown, the sections 110, 140 and the connectors 150 form a closed or endless loop.

The bail 100 may further include protective sleeves 160 covering the joints 104.

The inboard leg 101A has a lengthwise axis M-M. The outboard leg 101B has a lengthwise axis N-N. The side legs 101C and 101D have lengthwise axes P-P and Q-Q. In some embodiments, the axes M-M and N-N are substantially parallel. In some embodiments, the axes P-P and Q-Q are substantially parallel. In some embodiments, the legs 101A-D form a substantially rectangular shape.

In some embodiments, each leg 101A, 101B has a length L1 (FIG. 4) in the range of from about 4.375 to 4.625 inches. In some embodiments, each leg 101C, 101D has a length L2 in the range of from about 5.5 to 6 inches.

The inboard section 110 is elongate and generally U-shaped. The inboard section 110 includes a main leg 112 and opposed side legs 114. The main leg 112 is generally cylindrical in cross-section. The inboard section 110 includes a metal electrical conductor 120 surrounded by an electrical insulation layer 130.

The main leg 112 forms the inboard leg 101A. The side legs 114 form inner sections of the side legs 101C, 101D.

Terminal end sections 126 of the conductor 120 extend beyond the terminal ends 132 of the insulation layer 130 to the terminal ends 124 of the conductor 120.

The conductor 120 is formed of a multiple elongate, metal, electrically conductive wire strands 122. The wire strands 122 are bound together in a bundle 122A having a conductor outer surface 128. The wire strands 122 may extend parallel to each other or may be entwined with one another (e.g., the strands 122 may be helically twisted or braided with one another).

The wire strands 122 may be relatively displaceable and malleable or bendable.

In some embodiments, the number of strands 122 in the bundle 122A is in the range of from about 19 to 2109 strands.

Suitable materials for the conductor strands 122 may include aluminum or copper.

In some embodiments, each strand 122 has an outer diameter D3 (FIG. 3) in the range of from about 0.6 to 1.25 inches.

In some embodiments, the conductor 120 has an outer diameter D4 (FIG. 3) in the range of from about 0.285 to 0.125 inch.

The insulation layer 130 may be formed of a polymeric material such as EPDM, PVC, polypropylene, polyethylene, or cross-linked polyethylene.

In some embodiments, insulation layer 130 has a thickness T5 (FIG. 3) in the range of from about 0.075 to 0.125 inch.

The outboard section or outboard conductor 140 is elongate and generally U-shaped. The outboard section 140 includes a main leg 142 and opposed side legs 144. The main leg 142 is generally cylindrical in cross-section. The outboard section 140 is a metal electrical conductor having a bare or exposed metal surface 148 (i.e., the surface 148 is not surrounded by an electrical insulation layer).

The main leg 142 forms the outboard leg 101A. The side legs 144 form inner sections of the side legs 101C, 101D.

The main leg 142 of the outboard conductor 140 (and in some embodiments and as shown, the entirety of the outboard conductor 140) is formed of a single unitary, solid, metal, electrically conductive rod or wire. That is, rather than being formed of multiple, bundled strands as in the conductor 120, the outboard conductor 140 is a single piece of material. In some embodiments, the entire outboard leg 101B consists of a single unitary, solid, rigid piece of metal (i.e., the main leg 142 of the outboard conductor 140, having a bare, noninsulated surface 148). In some embodiments, the conductor 140 is homogenous in cross-section. In some embodiments, the conductor 140 is monolithic.

In some embodiments, the outboard conductor 140 is more rigid than the inboard conductor 120.

Suitable materials for the outboard conductor 140 may include aluminum or copper. In some embodiments, the outboard conductor 140 is a tin-plated solid copper rod. The outboard conductor 140 may be extruded, cast or molded, for example.

In some embodiments, the outboard conductor 140 has an outer diameter D6 (FIG. 6) in the range of from about 0.455 to 0.465 inch.

In other embodiments, portions of the outboard conductor 140 may be covered by an electrical insulation layer. In some embodiments, the entire outboard leg 101B consists of a single unitary, solid, rigid piece of metal (i.e., the main leg 142 of the outboard conductor 140) and a layer of electrical insulation surrounding some or all of the outer surface 148.

Each joint connector 150 is a tubular sleeve including a side wall 152 defining an inner bore 154A and an outer bore 154B. Each connector 150 is formed of a malleable, electrically conductive metal. Suitable materials for the connectors 150 may include aluminum or copper.

The protective sleeves 160 may be formed of a polymeric material such as an elastomer, thermoelastomer or thermoplastic material. In some embodiments, the protective sleeves 160 are formed of a heat shrinkable elastomer. In some embodiments, the protective sleeves 160 are formed of an electrically insulating material.

Figure 7:
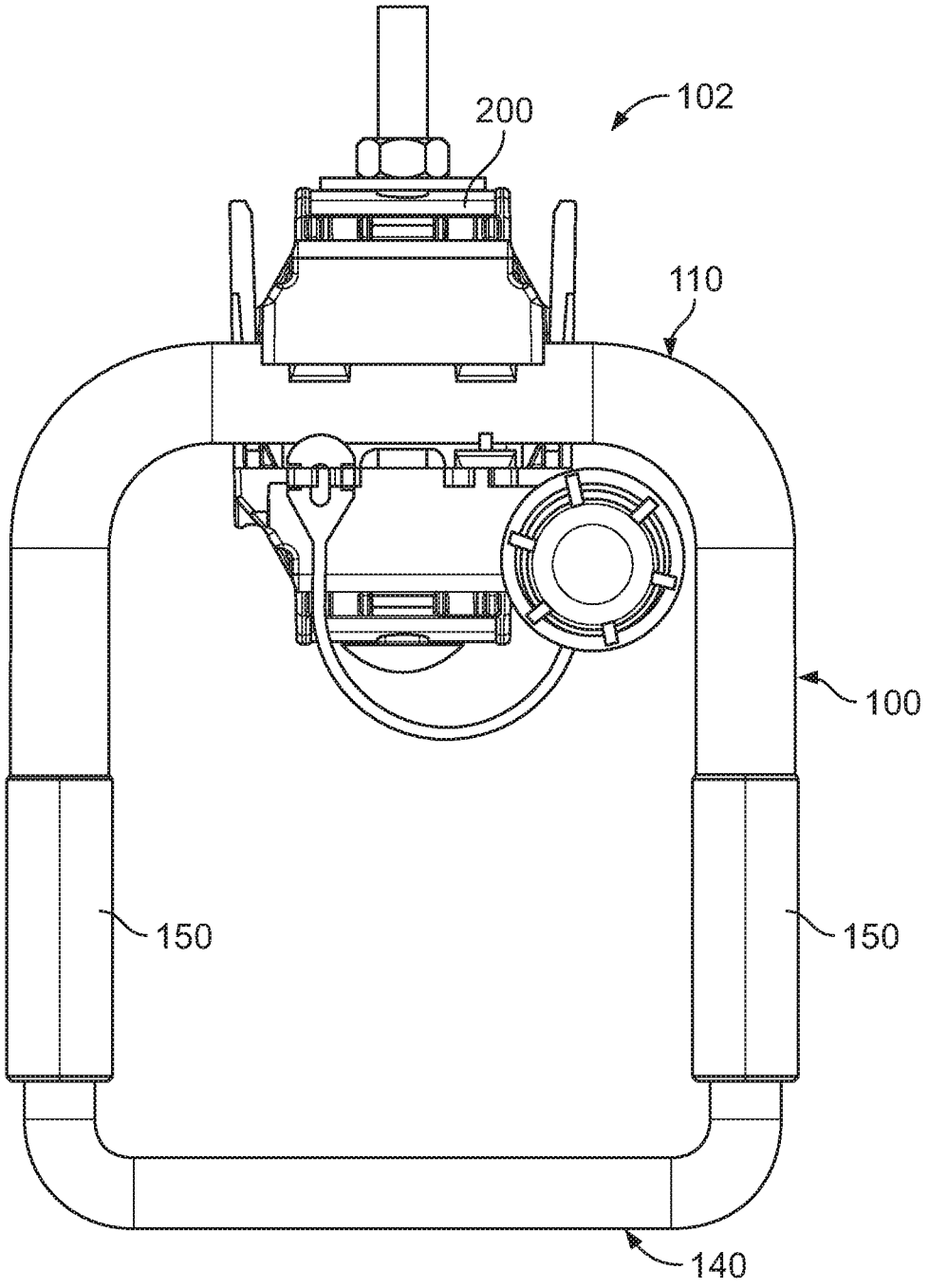
FIG. 7 is a front view of the stirrup of FIG. 1, wherein protective joint sleeves forming a part of the bail are not shown, in order to show the crimped joint connectors.
Figure 8:
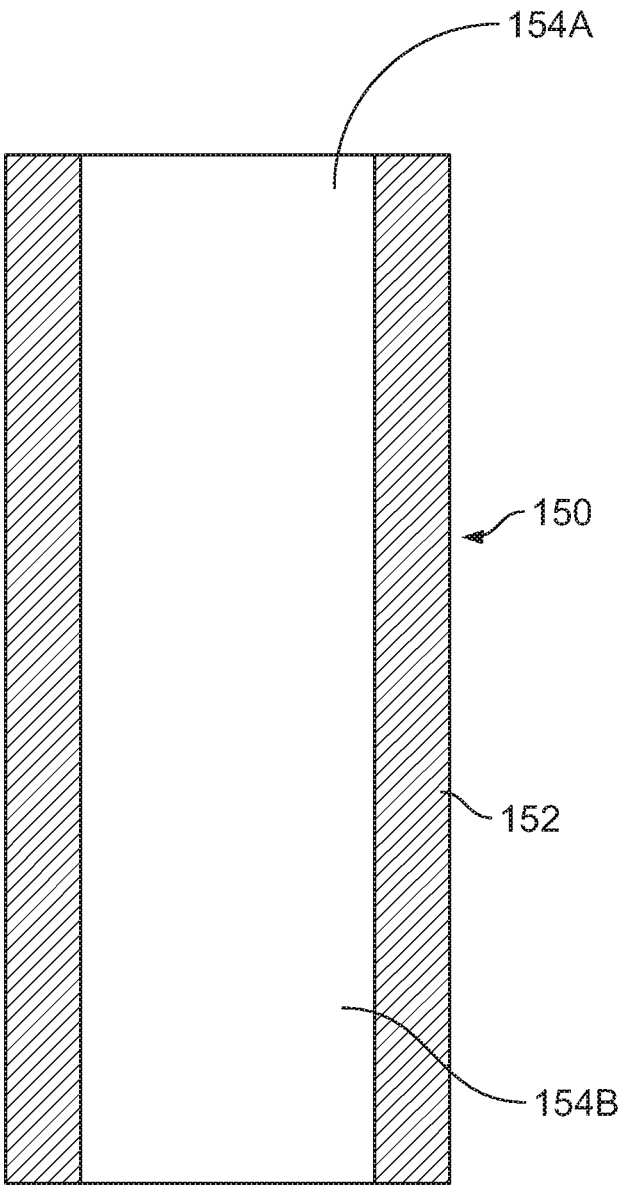
FIG. 8 is a cross-sectional view of a joint connector of the bail of FIG. 1, wherein the joint connector is shown prior to being crimped.
Figure 9:
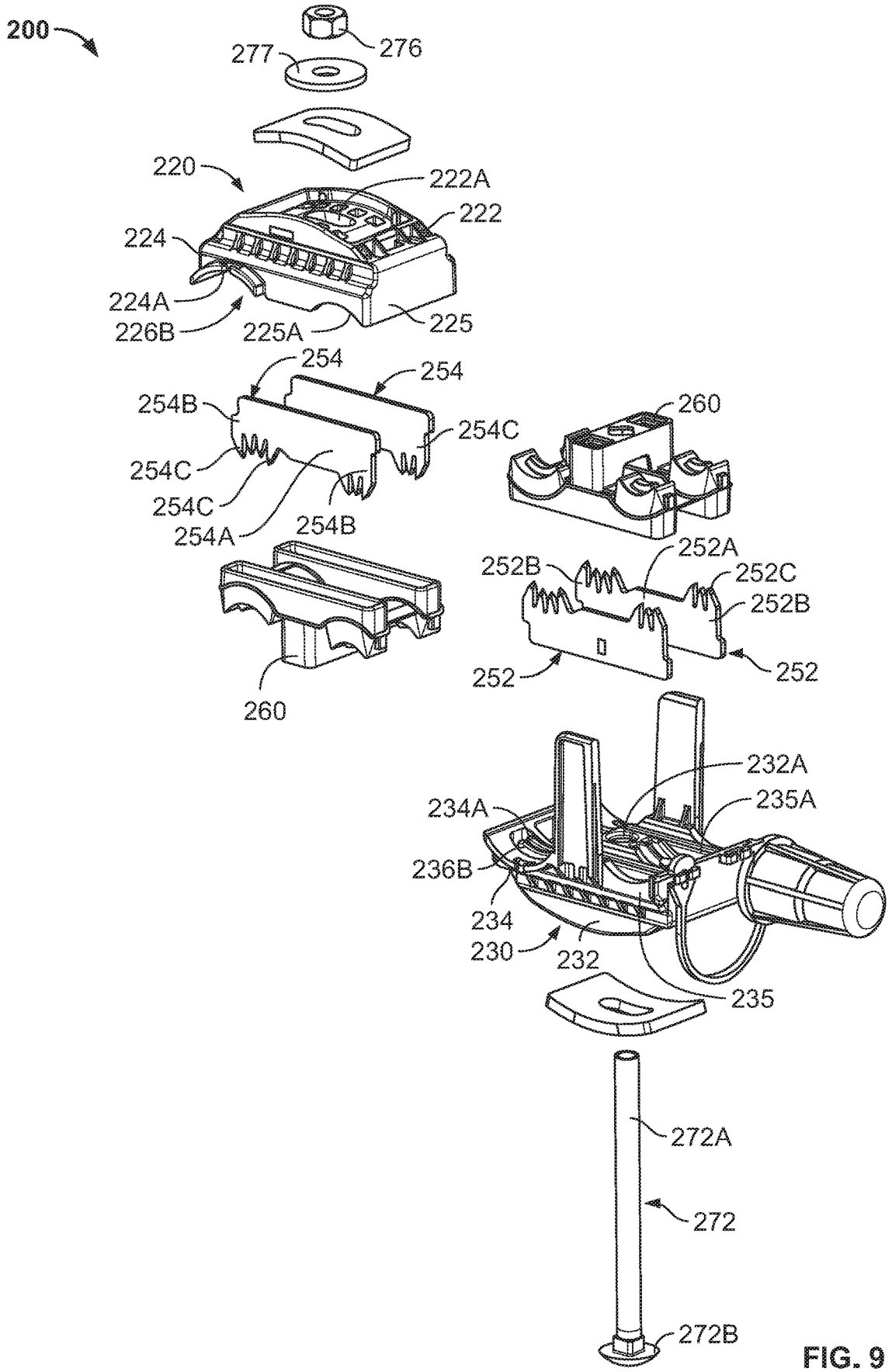
FIG. 9 is an exploded, perspective view of an insulation piercing connector forming a part of the stirrup of FIG. 1.
Figure 10:
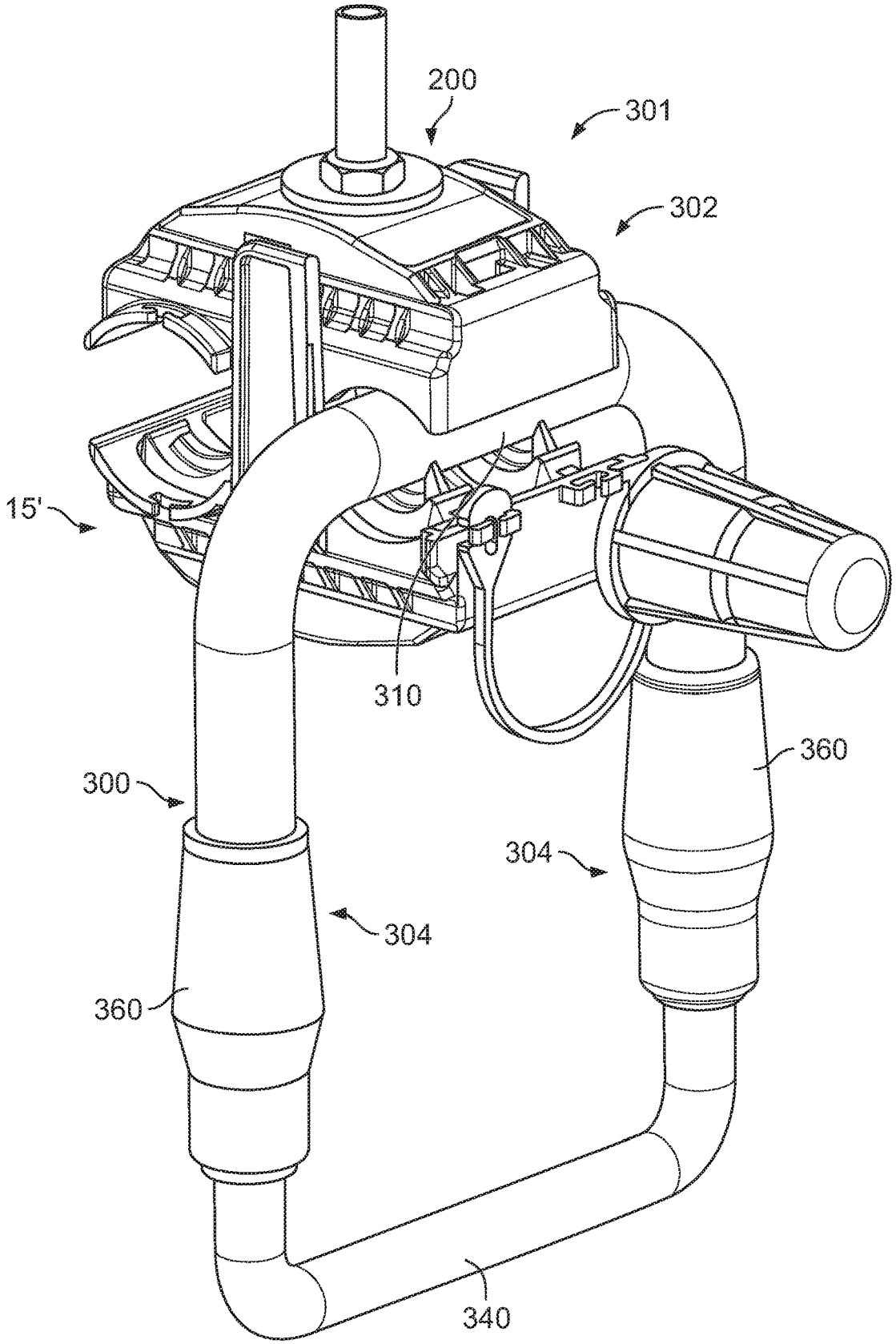
FIG. 10 is a perspective view of a stirrup system and a stirrup according to further embodiments.
Figure 11:
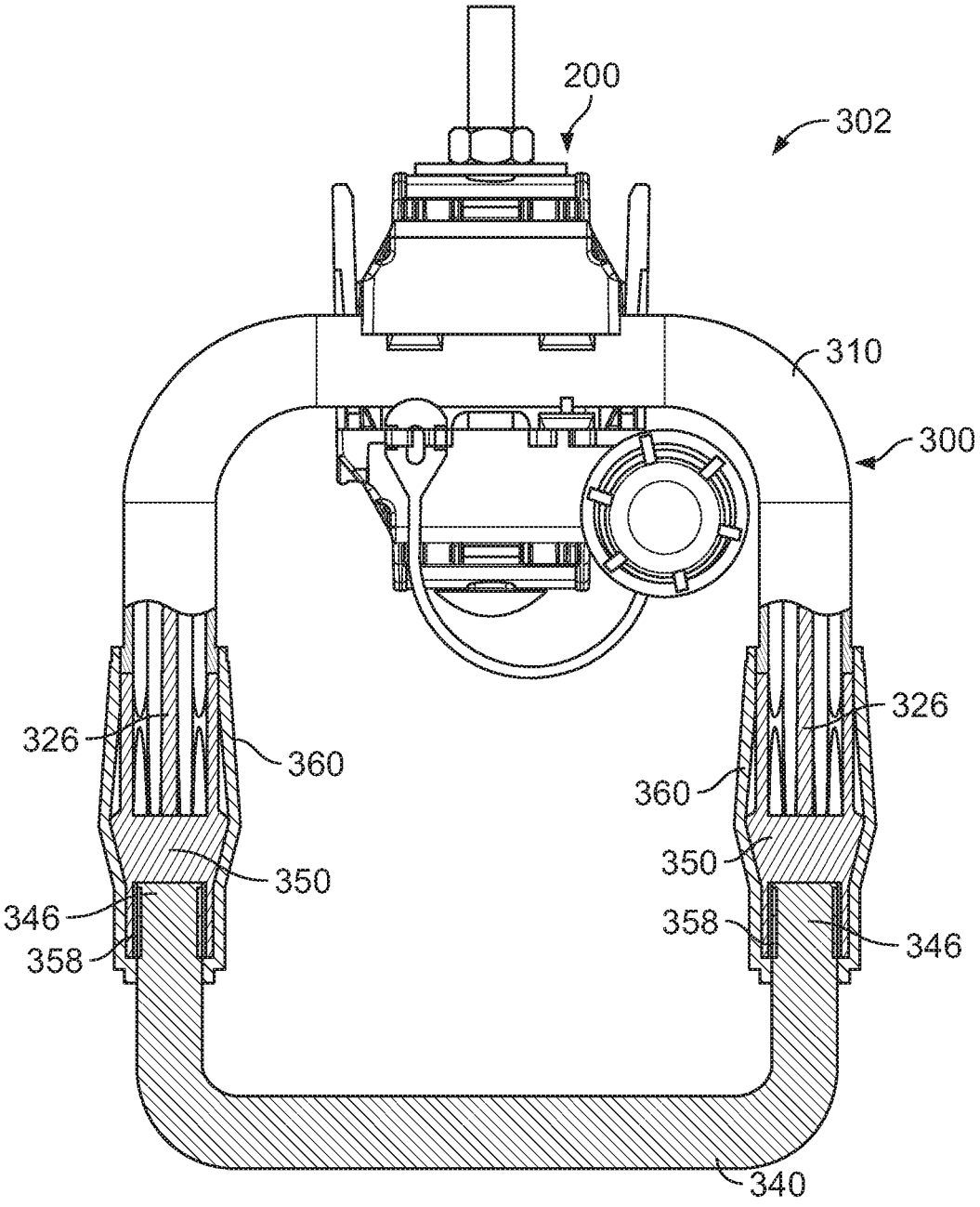
FIG. 11 is a fragmentary, front view of the stirrup of FIG. 10.
Figure 12:
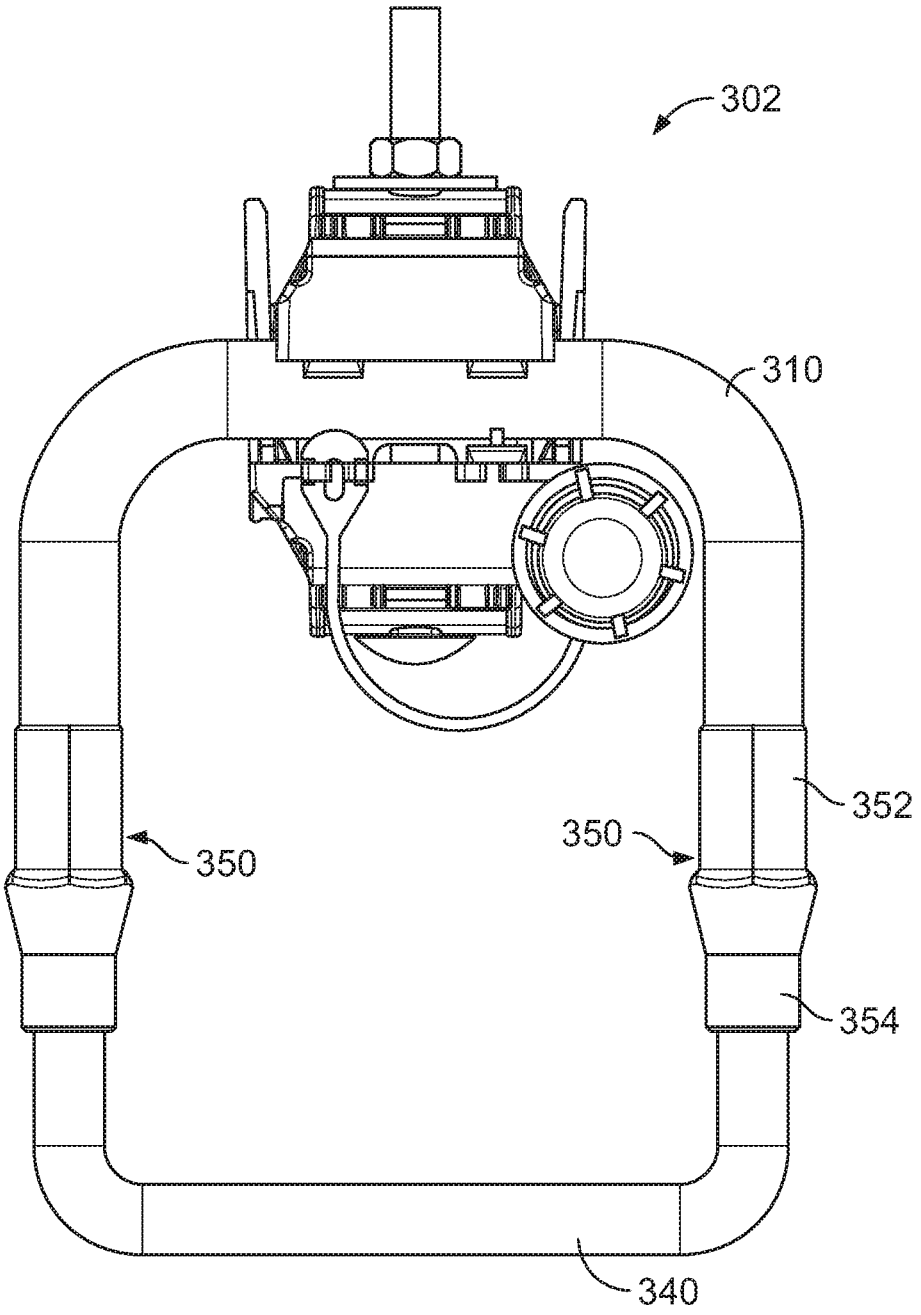
FIG. 12 is a front view of the stirrup of FIG. 10, wherein protective joint sleeves forming a part of a bail forming a part of the stirrup are not shown, in order to show crimped joint connectors.
Figure 13:
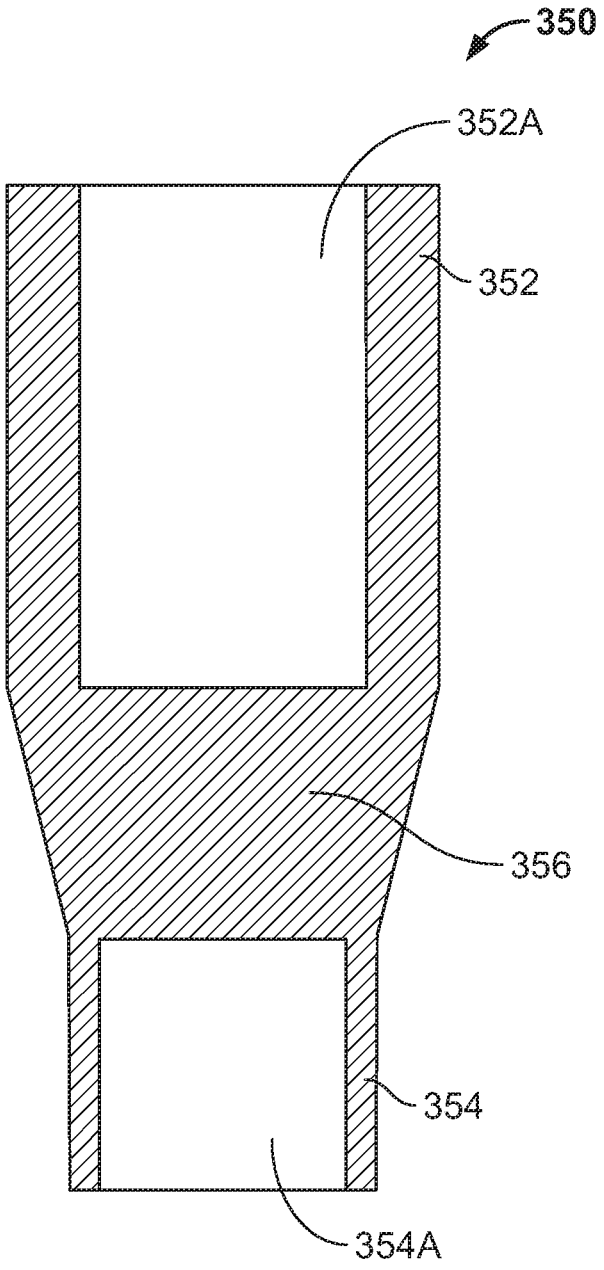
FIG. 13 is a cross-sectional view of a joint connector of the bail of FIG. 12, wherein the joint connector is shown prior to being crimped.

The bail 100 may be assembled as follows. The end sections 126 are inserted into the inner bores 154A. Terminal end sections 146 of the outboard conductor 140 are inserted into the bores 154B. The connectors 150 are crimped onto the end sections 126, 146 as shown in FIG. 7 to mechanically secure and electrically connect the conductors 120, 140 to the connectors 150. The conductors 120, 140 are thereby mechanically and electrically connected to one another.

The protective sleeves 160 are then installed over the connectors 150. In some embodiments, each sleeve 160 extends beyond the ends of its connector 150 and overlaps the conductor 140 and the insulation layer 130.

The main cable 12 may be a generally cylindrical high, medium or low voltage cable line. The cable 12 includes a metal electrical conductor 12A surrounded by an electrical insulation layer 12B. The conductor 12A may be formed as a bundle of multiple electrically conductive wire strands 12C (e.g., parallel or twisted strands) as illustrated in the figures. Suitable materials for the conductor 12 (i.e., the strands 12C) may include aluminum or copper. The insulation layer 12B may be formed of a polymeric material such as PVC, polypropylene, polyethylene, or cross-linked polyethylene. The cable 12 has a lengthwise axis R-R.

The second cable 14 may be a known electrically conductive metal high, medium or low voltage cable or line having a generally cylindrical form in an exemplary embodiment. The illustrated cable 14 is a bare conductor cable (i.e., non-insulated). The conductor 14 may be formed of multiple strands (e.g., parallel or twisted strands), or may be a solid cylindrical conductor (solid wire). Suitable materials for the conductor 14 may include aluminum or copper. The conductor 14 and the conductor 12A may be of the same wire gauge or different wire gauge in different applications. In some embodiments, the conductor 12A has a larger cross-sectional diameter than the conductor 14.

The connector 200 may be any suitable multi-cable insulation piercing connector. When installed on the first cable 12 and the bail 100, the connector 200 provides electrical connectivity between the conductor 12A and the bail 100. This connection may be used to feed electrical power from the main conductor 12A to the bail 100, and thereby to the tap cable 14 through the tap connector 40 in, for example, an electrical utility power distribution system.

With reference to FIGS. 1-3 and 9, the connector 200 includes a connector body assembly 210, a first pair of blade members 252 (hereinafter, the "lower blade members"), a second pair of blade members 254 (hereinafter, the "upper blade members"), seal members 260, and a clamping or compression mechanism 270. The connector 200 has a longitudinal axis G-G.

The connector body assembly 210 includes a first or upper body member 220, and a second or lower body member 230.

The upper body member 220 includes a support portion 222 and a pair of laterally opposed legs or jaw portions 224, 225 extending laterally from the support portion 222 with respect to the connector axis G-G. The support portion 222 includes a bore 222A. The jaw portion 224 includes a cable groove or seat 224A. The jaw portion 225 includes a cable groove or seat 225A. The jaw portion 224 further includes, in the cable seat 224A, a pair of blade slots or seats 224B. The jaw portion 225 further includes, in the cable seat 225A, a pair of blade slots or seats 226B.

The lower body member 230 includes a support portion 232 and a pair of laterally opposed legs or jaw portions 234, 235 extending laterally from the support portion 232 with respect to the connector axis G-G. The support portion 232 includes a bore 232A. The jaw portion 234 includes a cable groove or seat 234A. The jaw portion 235 includes a cable groove or seat 235A. The jaw portion 234 further includes, in the cable seat 234A, a pair of blade slots or seats 234B. The jaw portion 235 further includes, in the cable seat 235A, a pair of blade slots or seats 236B.

The jaw portion 224 and the jaw portion 234 define a first or main side cable receiving slot 211A therebetween. The jaw portion 225 and the jaw portion 235 define a second or tap side cable receiving slot 211B therebetween.

The body members 220, 230 may be formed of any suitable material. According to some embodiments, the body members 220, 230 are formed of a polymeric material. In some embodiments, the polymeric material is selected from the group consisting of polyamide (PA) 6.6, PA 6.6 reinforced with glass fibers or talc, polycarbonate, or polycarbonate blend. The body members 220, 230 may be formed using any suitable technique. According to some embodiments, the body members 220, 230 are molded. According to some embodiments, the each of the body members 220, 230 is monolithic and unitarily formed.

The compression mechanism 270 includes a bolt 272, and a torque control member in the form of a nut 276. A washer 277 may be provided between the nut 276 and the upper body member 220. However, other types of compression mechanisms may be used for the compression mechanism 270. For example, the compression mechanism may include an inclined surface device operable to provide mechanical advantage, for example.

The bolt 272 may be a carriage bolt and includes a threaded shank 272A, and a head 272B.

In some embodiments (not shown), the nut 276 is a shear nut or an additional shear nut is provided including a breakaway section. In some embodiments (not shown), the bolt 272 is a shear bolt including a breakaway section.

The bolt 272 extends through the bores 222A, 232A and is axially constrained by the bolt head 272B and the body member 230. The nut 276 is rotatably mounted on the bolt 272 and is axially constrained by the body member 220. The bores 222A, 232A may be round, or elongated, so that the upper connector body can rock as it is torqued down against two conductors with different outer diameters.

The axial spacing distance D1 (FIG. 2) between the cable seats 224A, 234A and 225A, 235A can be varied. The body member 220 can slide up and down the bolt 272 relative to the lower body member 230 another along a slide axis B-B. Accordingly, the heights of the slots 211A, 211B can be independently varied.

In use, the nut 276 is engaged by a driver and forcibly rotated thereby. The nut 276 may be faceted or otherwise shaped to mate with the tool. The nut 276 is thereby rotated relative to the axially and bolt 272, which may be rotationally constrained by a tool or an anti-rotation feature or mechanism of the connector 200. This causes the bolt 272 to translate up through the nut 276, which slides or translates the body portions 220 and 230 together (in respective converging directions) along the slide axis B-B. If a shear nut is provided, the shear head will shear off of a base portion at the breakaway section when subjected to a prescribed torque. The base portion may be faceted or otherwise configured to mate with a tool to enable loosening of the nut 276 to permit removal of the connector 200 from the cables.

According to some embodiments, the bolt 272 and the nut 276 may be formed of any suitable materials, such as steel (e.g., galvanized steel or stainless steel), aluminum alloy, plastic or zinc alloy.

Each lower blade member 252 is mounted in one of the blade slots 236B for movement with the upper body member 230. Each lower blade member 252 includes a body or base 252A having laterally opposed ends. Each end is provided with an integral cable engagement or insulation piercing feature 252B. Each insulation piercing feature 252B includes a plurality of serrations or teeth 252C separated by slots and having terminal points. The points of the teeth 252C may collectively lie on an arc generally corresponding to the profile of the arcuate outer surface of the corresponding cable conductor 12A, 14A.

Each upper blade member 254 is mounted in one of the blade slots 226B for movement with the upper body member 220. Each main blade member 254 includes a body or base 254A having axially opposed ends. Each end is provided with an integral cable engagement or insulation piercing feature 254B. Each insulation piercing feature 254B includes a plurality of serrations or teeth 254C separated by slots and having terminal points. The points of the teeth 254C may collectively lie on an arc generally corresponding to the profile of the arcuate outer surface of the corresponding conductor 12A, 120.

The blade members 252, 254 are affixed in their respective blade seats such that the teeth 254C of the blade members 254 face the teeth 252C of the blade members 252.

According to some embodiments, the width of each blade member 252, 254 is at least ten times its thickness. According to some embodiments, the thickness of each the blade member 252, 254 is in the range of from about 0.05 and 0.125 inch.

The blade members 252, 254 may be formed of any suitable electrically conductive material. According to some embodiments, the blade members 252, 254 are formed of metal. According to some embodiments, the blade members 252, 254 are formed of aluminum, aluminum alloy, or copper and may be galvanized. The blade members 252, 254 may be formed using any suitable technique. According to some embodiments, each blade members 252, 254 is monolithic and unitarily formed. According to some embodiments, each blade member 252, 254 is extruded and cut, stamped (e.g., die-cut), cast and/or machined.

The electrical connection system 10 and the stirrup system 101 can be used as follows in accordance with methods of the present invention to form the main connection assembly 15, the tap connection assembly 17, and the electrical connection assembly 11. Generally, the stirrup connection assembly 15 is first formed by installing the connector 200 on the cable 12 and the bail 100. Thereafter, the tap cable 14 is connected to the bail 100 using the tap connector 40.

The connector 200 and the bail 100 can be used as follows in accordance with methods of the present invention to form the connection 15.

If necessary, the compression mechanism 270 is loosened or opened to permit the jaw portions 224, 234 and 225, 235 (and thereby the blade members 252, 254) to be separated. The cable 12 (with the insulation layer 12B covering the conductor 12A) is inserted in or between the cable grooves 224A, 234A and the bail section 101A (with the insulation layer 130 covering the multi-strand conductor 120) is inserted in or between the cable grooves 225A, 235A. The cable 12 and the bail leg 101A can be axially or laterally inserted into the slots defined between the jaws.

The nut 276 is then driven to compress the compression mechanism 270 along the slide axis B-B and thereby drive the jaws 224, 234 and 225, 235 together along a clamping axis parallel to the slide axis B-B. The nut 276 is driven until a prescribed torque is applied. The nut 276 is driven until a prescribed torque is applied. If the nut 276 is a shear nut, the shear head will break off at the shear section, thereby helping to ensure that the proper load is applied to the blade members 252, 254.

As a result, the insulation piercing features 252B, 254B of the opposed pairs of the blade members 252, 254 are driven to converge on and capture the cable 12 and the bail leg 101A therebetween.

Figure 2:
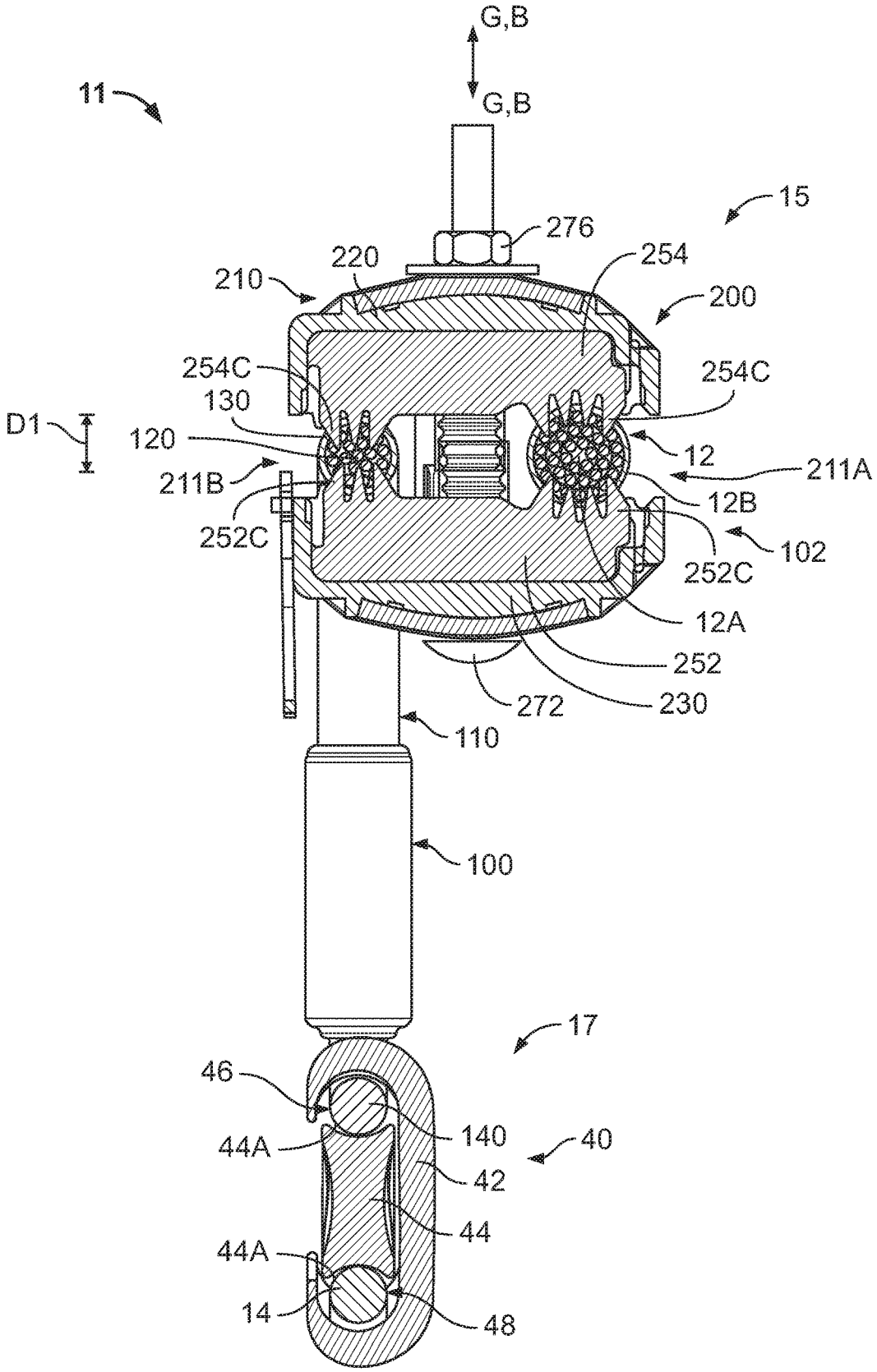
FIG. 2 is a cross-sectional view of the electrical connection assembly of FIG. 1 taken along the line 2-2 of FIG. 1.
Figure 3:
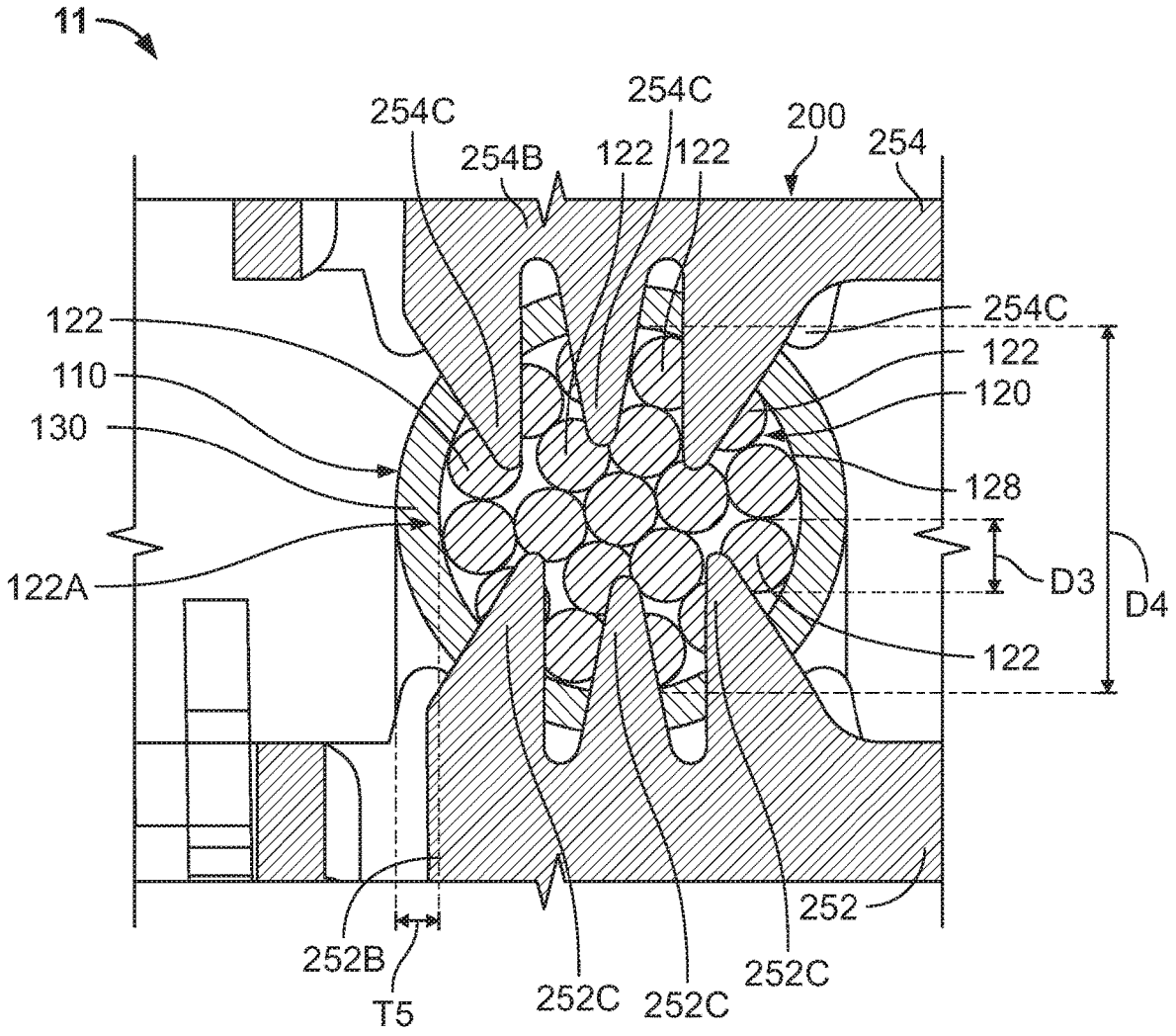
FIG. 3 is an enlarged, fragmentary, cross-sectional view of the electrical connection assembly of FIG. 1 taken along the line 2-2 of FIG. 1.

More particularly, the teeth 252C, 254C of each blade member 252, 254 are forced through the insulation layer 12B and into mechanical and electrical contact or engagement with the conductor 12A. Similarly, the teeth 252C, 254C of each blade member 252, 254 are forced through the insulation layer 130 of the main leg 112 and into mechanical and electrical contact or engagement with the conductor 120 (as shown in FIGS. 2 and 3).

In the foregoing manner, the connector 200 is operatively connected to the cable 12 and the bail 100 and the cable 12 and the bail 100 are electrically connected to one another without stripping the insulation layers 12B, 130.

Because the conductor 120 is a multi-strand conductor, the teeth 252C, 254C are able to embed into, form and enlarge spaces between adjacents strands 122 of the bundle 122A. For example, the teeth 252C, 254C can displaced the strands 122 and/or wedge radially in between the strands 122. In this way, the multi-strand conductor 120 can more closely and comprehensively conform to the blade members 252, 254. This improves the extent and quality of the electrical contact and mechanical contact between the blade members 252, 254 and the bail 100.

According to some embodiments, the teeth 252C, 254C embed in the conductors 12A, 120. According to some embodiments, the teeth 252C, 254C embed into the conductors 12A, 120 a distance of at least about 0.5 mm.

In the foregoing manner, the stirrup 101 and the connection 15 are formed. The blade members 252, 254 provide electrical continuity (i.e., a path for electrical current flow) between the conductors 12A, 120. The connector 200 mechanically secures the cable 12 and the bail 100 relative to one another.

The tap cable 14 is then coupled to the bail 100 by the tap connector 40. The tap connector 40 may be any suitable type of connector. In some embodiments and as shown, the tap connector 40 is a wedge connector. The wedge connector 40 includes a C-shaped sleeve 42 and a wedge member 44. One or both of the members 42, 44 are formed of electrically conductive metal. The sleeve 42 has opposed hook sections 42A. The wedge member 44 has opposed lateral channels 44A. The wedge member 44 is configured to be inserted into the sleeve 42 such that an upper passage 46 and an opposing lower passage 48 are defined a hook section 42A and a channel 44A on either side. Suitable tap connectors 40 may include the AMPACT™ Tap Connector wedge connector available from TE Connectivity.

To install the tap connector 40, the bail leg 101B is placed in the upper hook section 42A and the tap cable 14 is placed in the lower hook section 42A. The wedge member 44 is then inserted into the sleeve 42 to capture and clamp the cable 14 and the bail 100 as shown. The sleeve 42 and the wedge member 44 make mechanical and electrical contact with the bare surfaces of the conductor 140 and the tap cable 14. In this way, the tap cable 14 is electrically connected to the bail 100, and thereby to the cable 12 through the bail 100 and the IPC connector 200.

The bail 100 and the stirrup system 101 may provide a number of advantages. The insulation 130 on the stranded conductor 120 enables the teeth 252C, 254C (contact points) to penetrate through the insulation 130 and "bite" or embed into the cable bundle of strands 122, which provides superior contact as compared to a solid rod conductor, for example. Thus, the stranded conductor 120 enables the IPC connector 200 to make improved electrical contact between the blade members 252, 254 and the bail 100 under force.

The stranded conductor 120, as well as the insulation layer 130, provide improved mechanical secureness or strain relief at the connection between the IPC connector 200 and the bail 100. The malleable stranded conductor 120 reduces the risk of damage to the teeth of the blade members 252, 254.

The bail 100 provides improved safety because the insulation layer 130 and the sleeves 160 completely cover the electrically conductive surfaces of the bail 100 except the side of the bail 100 used as a point of contact for hot line connectors or clamps. The protective sleeves 160 environmentally seal and electrically insulate the crimped portions of the bail 100.

In field application, the stirrup 102 (i.e., the IPC connector 200 in combination with the bail 100) is attached to the overhead main line 12 and left in place as a connection point for other equipment and services. The user is then able to make connections by attaching a hot line clamp 40 to the main line 12 via the bail 100 using hot sticks, for example.

A second conductor (tap) 14 attached to the clamp 40 allows power to be drawn off the main line 12 and delivered to the user or next service point. Sometimes the hot line clamp 40 must be removed from the line 12 to disconnect power flow. If the frequent connect/disconnect operations were performed directly on the main line 12—without using a stirrup (e.g., the stirrup 102)—the line 12 may eventually become compromised due to arcing and burning of wire strands which occurs under live conditions. The utility would be faced with much higher line inspection and maintenance cost to avoid significant safety hazards presented by this impairment to its infrastructure.

According to some embodiments, the IPC connector 200 and the bail 100 are pre-configured or packaged as a matched kit. However, the IPC connector 200 and the bail 100 need not be provided as a kit.

It will be appreciated that stirrup systems and bails in accordance with the present invention may have components (e.g., the IPC connector 200 and the bail 100, etc.) having shapes, configurations and/or sizes different than those shown and described herein.

According to some embodiments, the cables 12, 14 are power transmission conductors. According to some embodiments, the cables 12, 14 are aerial power transmission conductors. According to some embodiments, the cable 12 is a main line electrical conductor cable and the cable 14 is a tap line electrical conductor cable.

According to some embodiments, the conductors 12, 14 have a diameter of from about 0.528 to 1.05 inches.

With reference to FIGS. 10-13, a bail 300, a stirrup system 301, and a stirrup 302 according to further embodiments of the present invention are shown therein. The stirrup system 301 includes the bail 300 and the insulation piercing connector 200, and can be assembled to form the stirrup 302. The bail 300, the stirrup system 301, and the stirrup 302 correspond to the bail 100, the stirrup system 101, and the stirrup 102, except as discussed below.

The stirrup system 301 can be used in the same manner as described for the stirrup system 101 to form a main connection assembly 15' with cable 12, and to form a tap connection assembly with the tap cable 14 and the tap connector 40.

The bail 300 includes an inboard section or member 310, an outboard section or member 340, a pair of joint connectors 350, and protective sleeves 360 corresponding to the inboard member 110, the outboard member 140, and the protective sleeves 160.

The bail 300 differs from the bail 100 in that the joints 304 between the members 310, 340 are differently constructed than the joints 104. Each joint connector 350 (FIG. 13) includes an inner side wall 352 defining an inner bore 352A, an outer side wall 354 defining an outer bore 354A, and a partition wall 356 between the bores 352A, 352B. The exposed end sections 326 of the multi-strand conductor 320 are seated in the bores 352A and secured therein by crimping the side wall 352 onto the end sections 326. The end sections 346 of the solid rod conductor 340 are seated in the bores 354A and secured therein by brazing or solder 358. The use of the soldered connection can enable a smaller connection so that the bail 300 is better streamlined.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A bail for forming a mechanical and electrical connection, the bail comprising:

an inboard section including an elongate, electrically conductive multi-strand conductor; and an outboard section including an elongate, electrically conductive solid rod conductor electrically connected to the multi-strand conductor wherein:

the inboard section and the outboard section are electrically and mechanically connected at a pair of opposed joints;

the bail forms a closed loop;

each of the joints includes a joint connector coupling an end of the inboard section to an end of the outboard section; and the joint connector of each joint is crimped onto each of the end of the inboard section and the end of the outboard section coupled by the joint connector.

2. The bail of claim 1 wherein at least a portion of the solid rod conductor is non-insulated and exposed.

3. The bail of claim 1 wherein the inboard section includes a polymeric electrical insulation layer surrounding the multi-strand conductor.

4. A bail for forming a mechanical and electrical connection, the bail comprising:

an inboard section including an elongate, electrically conductive multi-strand conductor; and an outboard section including an elongate, electrically conductive solid rod conductor electrically connected to the multi-strand conductor wherein:

the inboard section and the outboard section are electrically and mechanically connected at a pair of opposed joints;

the bail forms a closed loop;

each of the joints includes a joint connector coupling an end of the inboard section to an end of the outboard section; and the joint connector of each joint is crimped onto the end of the inboard section and soldered onto the end of the outboard section.

5. The bail of claim 4 wherein at least a portion of the solid rod conductor is non-insulated and exposed.

6. The bail of claim 4 wherein the inboard section includes a polymeric electrical insulation layer surrounding the multi-strand conductor.

7. A stirrup system including:

a bail including:

an inboard section including an elongate, electrically conductive multi-strand conductor; and an outboard section including an elongate, electrically conductive solid rod conductor electrically connected to the multi-strand conductor; and an insulation piercing connector including:

at least one electrically conductive piercing member; and a clamping mechanism configured and operable to force the at least one piercing member into electrical engagement with the multi-strand conductor.

8. The stirrup system of claim 7 wherein:

the insulation piercing connector is configured to mechanically and electrically connect the bail to a cable, the cable including a cable conductor covered by a cable insulation layer;

the inboard section includes a bail insulation layer covering the multi-strand conductor; and the clamping mechanism is configured and operable to force the at least one piercing member through the bail insulation layer and the cable insulation layer and into electrical engagement with the multi-strand conductor and the cable conductor such that the multi-strand conductor and the cable conductor are electrically connected to one another through the at least one piercing member, and the solid rod conductor is thereby electrically connected to the cable conductor.

9. The stirrup system of claim 7 wherein the multi-strand conductor includes a plurality of electrical conductor strands configured in a bundle.

10. The stirrup system of claim 7 wherein at least a portion of the solid rod conductor is non-insulated and exposed.

11. The stirrup system of claim 10 wherein the inboard section includes a polymeric electrical insulation layer surrounding the multi-strand conductor.

12. The stirrup system of claim 7 wherein:

the inboard section and the outboard section are electrically and mechanically connected at a pair of opposed joints; and the bail forms a closed loop.

13. The stirrup system of claim 12 wherein each of the joints includes a joint connector coupling an end of the inboard section to an end of the outboard section.

14. The stirrup system of claim 7 wherein the inboard section includes a polymeric electrical insulation layer surrounding the multi-strand conductor.

15. A method for forming an electrical connection assembly with a cable, the cable including a cable conductor covered by a cable insulation layer, the method comprising:

providing a bail including:

an inboard section including an elongate, electrically conductive multi-strand conductor; and an outboard section including an elongate, electrically conductive solid rod conductor electrically connected to the multi-strand conductor; and providing an insulation piercing connector including:

at least one electrically conductive piercing member; and a clamping mechanism; and selectively operating the clamping mechanism to force the at least one piercing member through the cable insulation layer and into electrical engagement with the multi-strand conductor and the cable conductor such that the multi-strand conductor and the cable conductor are electrically connected to one another through the at least one piercing member, and the solid rod conductor is thereby electrically connected to the cable conductor.

16. The method of claim 15 wherein:

the inboard section includes a bail insulation layer covering the multi-strand conductor; and the method includes selectively operating the clamping mechanism to force the at least one piercing member through the bail insulation layer and the cable insulation layer and into electrical engagement with the multi-strand conductor and the cable conductor such that the multi-strand conductor and the cable conductor are electrically connected to one another through the at least one piercing member, and the solid rod conductor is thereby electrically connected to the cable conductor.

17. The method of claim 15 wherein the multi-strand conductor includes a plurality of electrical conductor strands configured in a bundle.

18. The method of claim 15 wherein at least a portion of the solid rod conductor is non-insulated and exposed.

19. The method of claim 15 wherein:

the inboard section and the outboard section are electrically and mechanically connected at a pair of opposed joints; and the bail forms a closed loop.

20. The method of claim 19 wherein each of the joints includes a joint connector coupling an end of the inboard section to an end of the outboard section.

21. The method of claim 15 wherein the inboard section includes a polymeric electrical insulation layer surrounding the multi-strand conductor.

22. An electrical connection assembly comprising:

a cable including a cable conductor covered by a cable insulation layer;

a bail including:

an inboard section including an elongate, electrically conductive multi-strand conductor; and an outboard section including an elongate, electrically conductive solid rod conductor electrically connected to the multi-strand conductor; and an insulation piercing connector including at least one piercing member penetrating through the cable insulation layer and into electrical engagement with the multi-strand conductor and the cable conductor such that the multi-strand conductor and the cable conductor are electrically connected to one another through the at least one piercing member, and the solid rod conductor is thereby electrically connected to the cable conductor.

23. The electrical connection assembly of claim 22 wherein:

the inboard section includes a bail insulation layer covering the multi-strand conductor; and the at least one piercing member penetrates through the bail insulation layer and the cable insulation layer and into electrical engagement with the multi-strand conductor and the cable conductor such that the multi-strand conductor and the cable conductor are electrically connected to one another through the at least one piercing member, and the solid rod conductor is thereby electrically connected to the cable conductor.

24. The electrical connection assembly of claim 23 wherein the insulation piercing connector includes a clamping mechanism configured and operable to force the at least one piercing member through the bail insulation layer and the cable insulation layer and into electrical engagement with the multi-strand conductor and the cable conductor such that the multi-strand conductor and the cable conductor are electrically connected to one another through the at least one piercing member and the solid rod conductor is thereby electrically connected to the cable conductor.

25. The electrical connection assembly of claim 22 wherein the multi-strand conductor includes a plurality of electrical conductor strands configured in a bundle.

26. The electrical connection assembly of claim 22 wherein at least a portion of the solid rod conductor is non-insulated and exposed.

27. The electrical connection assembly of claim 22 wherein:

the inboard section and the outboard section are electrically and mechanically connected at a pair of opposed joints; and the bail forms a closed loop.

28. The electrical connection assembly of claim 27 wherein each of the joints includes a joint connector coupling an end of the inboard section to an end of the outboard section.

29. The electrical connection assembly of claim 22 wherein the inboard section includes a polymeric electrical insulation layer surrounding the multi-strand conductor.

* * * * *